US009705206B2

(12) United States Patent
Yosui

(10) Patent No.: US 9,705,206 B2
(45) Date of Patent: Jul. 11, 2017

(54) ANTENNA DEVICE AND ELECTRONIC APPARATUS

(71) Applicant: Murata Manufacturing Co., Ltd., Nagaokakyo-shi, Kyoto-fu (JP)

(72) Inventor: Kuniaki Yosui, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 129 days.

(21) Appl. No.: 14/591,038

(22) Filed: Jan. 7, 2015

(65) Prior Publication Data

US 2015/0116168 A1 Apr. 30, 2015

Related U.S. Application Data

(63) Continuation of application No. PCT/JP2013/083601, filed on Dec. 16, 2013.

(30) Foreign Application Priority Data

Dec. 21, 2012 (JP) ..... 2012-280243

(51) Int. Cl.
*H01Q 1/00* (2006.01)
*H01Q 21/28* (2006.01)
(Continued)

(52) U.S. Cl.
CPC ..... *H01Q 21/28* (2013.01); *H01Q 1/2208* (2013.01); *H01Q 1/2216* (2013.01); *H01Q 1/243* (2013.01);
(Continued)

(58) Field of Classification Search
CPC ..... H01Q 21/28
(Continued)

(56) References Cited

U.S. PATENT DOCUMENTS

2006/0097918 A1 5/2006 Oshiyama et al.
2007/0139277 A1* 6/2007 Nissinen ..... H01Q 1/243 343/700 MS
(Continued)

FOREIGN PATENT DOCUMENTS

| | | | |
|---|---|---|---|
| EP | 2 182 577 | A1 | 5/2010 |
| EP | 2 528 165 | A1 | 11/2012 |
| JP | 3889423 | B2 | 3/2007 |
| JP | 2007-194995 | A | 8/2007 |
| JP | 2008-028734 | A | 2/2008 |
| JP | 2011-109190 | A | 6/2011 |
| WO | 2004/047223 | A1 | 6/2004 |
| WO | 2010/137061 | A1 | 12/2010 |
| WO | 2011/158844 | A1 | 12/2011 |

OTHER PUBLICATIONS

Official Communication issued in International Patent Application No. PCT/JP2013/083601, mailed on Mar. 18, 2014.

*Primary Examiner* — Graham Smith
*Assistant Examiner* — Jae Kim
(74) *Attorney, Agent, or Firm* — Keating & Bennett, LLP

(57) ABSTRACT

A square bracket-shaped radiation element is in a non-ground region of a board. A first reactance element that equivalently enters a short-circuited state in a second frequency band is connected between a second end of the radiation element and a ground conductor. A second reactance element that equivalently enters a short-circuited state in a first frequency band s connected between a first end of the radiation element and the ground conductor. In the UHF band, the radiation element and the ground conductor function as an inverted F antenna that contributes to field emission. In the HF band, a loop including the radiation element and the ground conductor functions as a loop antenna that contributes to magnetic field emission.

18 Claims, 12 Drawing Sheets

(51) Int. Cl.

| | |
|---|---|
| ***H01Q 7/00*** | (2006.01) |
| ***H01Q 1/22*** | (2006.01) |
| ***H01Q 1/24*** | (2006.01) |
| ***H01Q 9/42*** | (2006.01) |
| ***H01Q 5/328*** | (2015.01) |
| ***H01Q 5/335*** | (2015.01) |
| ***H01Q 5/371*** | (2015.01) |

(52) U.S. Cl.
CPC ..... *H01Q 5/328* (2015.01); *H01Q 5/335* (2015.01); *H01Q 5/371* (2015.01); *H01Q 7/00* (2013.01); *H01Q 9/42* (2013.01)

(58) Field of Classification Search
USPC ..... 343/749, 700 MS
See application file for complete search history.

(56) References Cited

U.S. PATENT DOCUMENTS

| | | | | |
|---|---|---|---|---|
| 2009/0251383 | A1 | 10/2009 | Tani et al. | |
| 2012/0299785 | A1* | 11/2012 | Bevelacqua ..... | H01Q 9/42 343/702 |
| 2013/0127573 | A1 | 5/2013 | Nakano et al. | |
| 2014/0035793 | A1* | 2/2014 | Kato ..... | H01Q 1/243 343/867 |

* cited by examiner

ANTENNA DEVICE AND ELECTRONIC APPARATUS

BACKGROUND OF THE INVENTION

1. Field of the Invention

The present invention relates to antenna devices that are shared by communication systems that use communication signals in mutually different frequency bands and to electronic apparatuses that include such antenna devices.

2. Description of the Related Art

With recent advancements in functionality, antennas not only for voice communication but also for various communication (broadcasting) systems, such as a GPS, a wireless LAN, and terrestrial digital broadcasting, are being embedded in such systems.

Japanese Unexamined Patent Application Publication No. 2007-194995, for example, discloses an antenna device that is shared by communication systems that use communication signals in mutually different frequency bands.

Housings, which used to be made of resin, of small communication terminal apparatuses, such as cellular phone terminals, have their entire surface plated with metal or the like in order to counter a degradation in the mechanical strength associated with the reduction in the size and thickness of the housings, and thus the housings are being "metalized." However, if an antenna is embedded inside a metalized housing, a signal outputted via the antenna is blocked by the metal, leading to a problem in that communication is not possible. Therefore, typically, a structure in which part of a housing is formed of nonmetal, and an antenna is mounted in the vicinity of the nonmetal portion is employed.

Recently, however, a case in which an HF band RFID system, such as NFC (Near Field Communication), is embedded has been increasing. If an antenna coil used in this HF band RFID system is to be disposed in the nonmetal portion as well, it becomes very difficult to secure a space necessary for the antenna.

In other words, how to form and integrate an antenna applied in a plurality of frequency bands has been an issue.

The aforementioned situation is applicable not only to an antenna for communication or broadcast reception but also to an electronic apparatus that includes an antenna for electric power transmission (electric power transmission/reception unit) in a similar manner.

SUMMARY OF THE INVENTION

Preferred embodiments of the present invention provide a small-sized antenna device that is configured to be shared by a plurality of systems for mutually different frequency bands, and an electronic apparatus that includes such an antenna device.

An antenna device according to a preferred embodiment of the present invention includes a radiation element of an electric field type antenna, and a ground conductor disposed so as to face the radiation element.

At least one first reactance element is connected between the radiation element and the ground conductor, and the radiation element, the first reactance element, and the ground conductor define a loop circuit of a magnetic field type antenna.

According to the above configuration, the radiation element is configured to define and function inherently as a field emission element in a first frequency band (e.g., UHF band) and is configured to define and function as a magnetic field emission element in a second frequency band (e.g., HF band) as the whole or part of the radiation element is shared as part of the loop. Thus, the radiation element is capable of being shared by a system that uses the first frequency band and a system that uses the second frequency band, and the size of the antenna device is thus capable of being reduced.

It is preferable that the radiation element be an antenna element for the first frequency band and that the loop circuit be an antenna element for the second frequency band that is lower than the first frequency band.

It is preferable that the first reactance element be an element whose impedance is closer to a short-circuited state in the second frequency band than in the first frequency band and is closer to an open state in the first frequency band than in the second frequency band, and that the first reactance element be provided at a position at which the first reactance element, the radiation element, and the ground conductor define the loop circuit when the first reactance element is closer to the short-circuited state. Through this, the first reactance element does not affect an antenna operation in the first frequency band, and the loop circuit is configured to define and function as an antenna in the second frequency.

It is preferable that the first reactance element be an inductor that becomes capacitive in the first frequency band and becomes inductive in the second frequency band. With this configuration, the first reactance element is capable of being used as a capacitance in a resonant circuit at a used frequency in the first frequency band (UHF band) and is capable of being used as an inductance in a resonant circuit in the second frequency band (HF band).

It is preferable that the antenna device include a second reactance element that is connected in series respectively with the first reactance element, the radiation element, and the ground conductor, and that the second reactance element be an element (capacitor) whose impedance is closer to an open state in the second frequency band than in the first frequency band and is closer to a short-circuited state in the first frequency band than in the second frequency band.

With the above configuration, the second reactance element is configured to be used as a grounded end in a used frequency in the first frequency band (e.g., UHF band), and the radiation element is capable of being used as a radiation element of a one end ground in the first frequency band.

In the preferred embodiment of the present invention described above, it is preferable that the second reactance element be a capacitor that becomes inductive in the first frequency band and becomes capacitive in the second frequency band. With this configuration, this capacitor is configured to be used as a capacitance in a resonant circuit in the second frequency band (e.g., HF), and the resonant frequency of such a resonant circuit is determined. In addition, a portion between the capacitor and the radiation element (two ends of the second reactance element) preferably is configured to be used as a feeding unit of a communication signal of the second frequency band.

It is preferable that the first reactance element (inductor), the second reactance element (capacitor), and a feeder circuit that feeds communication signals of the second frequency band to respective ends of the second reactance element define a single high frequency module. With this configuration, the number of components to be mounted is reduced, and the structure of the radiation element is simplified.

It is preferable that the antenna device include a third reactance element that is connected to a feeding point of a communication signal of the first frequency band to the radiation element (connected between the feeding point and the feeder circuit of a communication signal of the first frequency band) and that has a higher impedance in the second frequency band than in the first frequency band. With this configuration, the third reactance element is connected between the feeder circuit of a communication signal of the first frequency band and the feeding point of the communication signal of the first frequency band, and this third reactance element defines and functions as a decoupling element for a signal of the second frequency band. Thus, the feeder circuit of the first frequency band does not affect negatively during communication in the second frequency band.

It is preferable that the antenna device include, as necessary, a feeder coil to which a feeder circuit of a communication signal of the second frequency band is connected and that undergoes magnetic field coupling with the loop. This configuration makes a circuit for directly feeding to the radiation element unnecessary, and the feeding structure and the configuration of the feeder circuit are simplified. In addition, in a case in which the feeder coil defines and functions as an RFID antenna, the loop circuit is capable of being used as a resonance booster of the RFID antenna.

For example, the radiation element is an antenna for cellular communication, and the loop circuit is an antenna for an HF band RFID system.

It is preferable that the first reactance element be defined by connecting a plurality of reactance elements in series. With this configuration, even in a case in which each of the plurality of reactance elements undergoes self resonance due to a parasitic component, the reactance elements become an open state at respective resonant frequencies. Therefore, the radiation element defines and functions as an antenna in these resonant frequencies, and thus the band is broadened.

An electronic apparatus according to another preferred embodiment of the present invention includes the antenna device according to one of the preferred embodiments of the present invention described above, a first feeder circuit configured to feed a communication signal of the first frequency band to the antenna device, and a second feeder circuit configured to feed a communication signal of the second frequency band or electric power to the antenna device.

According to various preferred embodiments of the present invention, a radiation element is configured to define and function as a field emission element in a first frequency band and function as a magnetic field emission element in a second frequency band. Thus, the radiation element is configured to be shared by a communication system that uses the first frequency band and a communication system that uses the second frequency band, and the size of an antenna device is significantly reduced.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
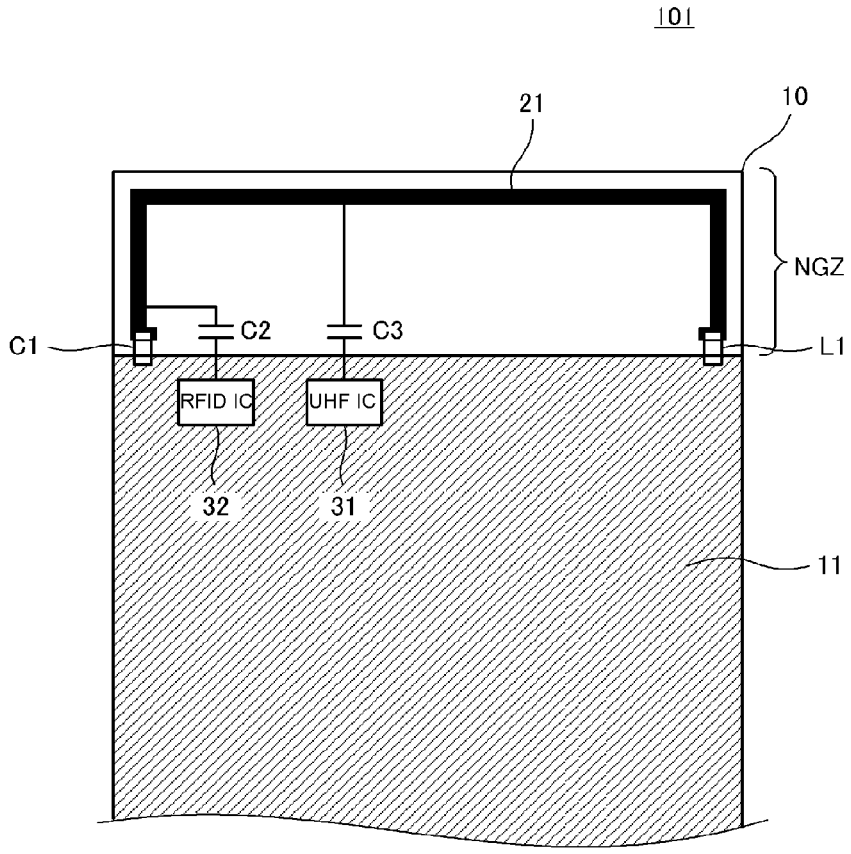
FIG. 1 is a plan view of a primary portion of an antenna device 101 according to a first preferred embodiment of the present invention.

FIG. 1 is a plan view of a primary portion of an antenna device 101 according to a first preferred embodiment of the present invention. This antenna device 101 is provided on a board 10. The board 10 includes a region where a ground conductor 11 is located and a non-ground region NGZ where the ground conductor is not located. A square bracket-shaped radiation element 21 is located in the non-ground region NGZ. Specifically, this radiation element 21 includes a portion that is parallel or substantially parallel to an edge side of the ground conductor 11 and portions that extend from the parallel portion toward the ground conductor. A chip capacitor (capacitor) C1 is mounted between a first end of the radiation element 21 and the ground conductor 11 and is electrically connected therebetween. In addition, a chip inductor L1 is mounted between a second end of the radiation element 21 and the ground conductor 11 and is electrically connected therebetween. The inductor L1 corresponds to a first reactance element, and the capacitor C1 corresponds to a second reactance element.

On the board 10, a first feeder circuit 31 is defined by a UHF band (first frequency band) IC, and a second feeder circuit 32 is defined by an HF band (second frequency band) RFID IC.

An input/output portion of the first feeder circuit 31 is connected to a predetermined feeding point of the radiation element 21 through a capacitor C3. Meanwhile, an input/output portion of the second feeder circuit 32 is connected to a point in the vicinity of the first end of the radiation element 21 through a capacitor C2.

Figure 2:
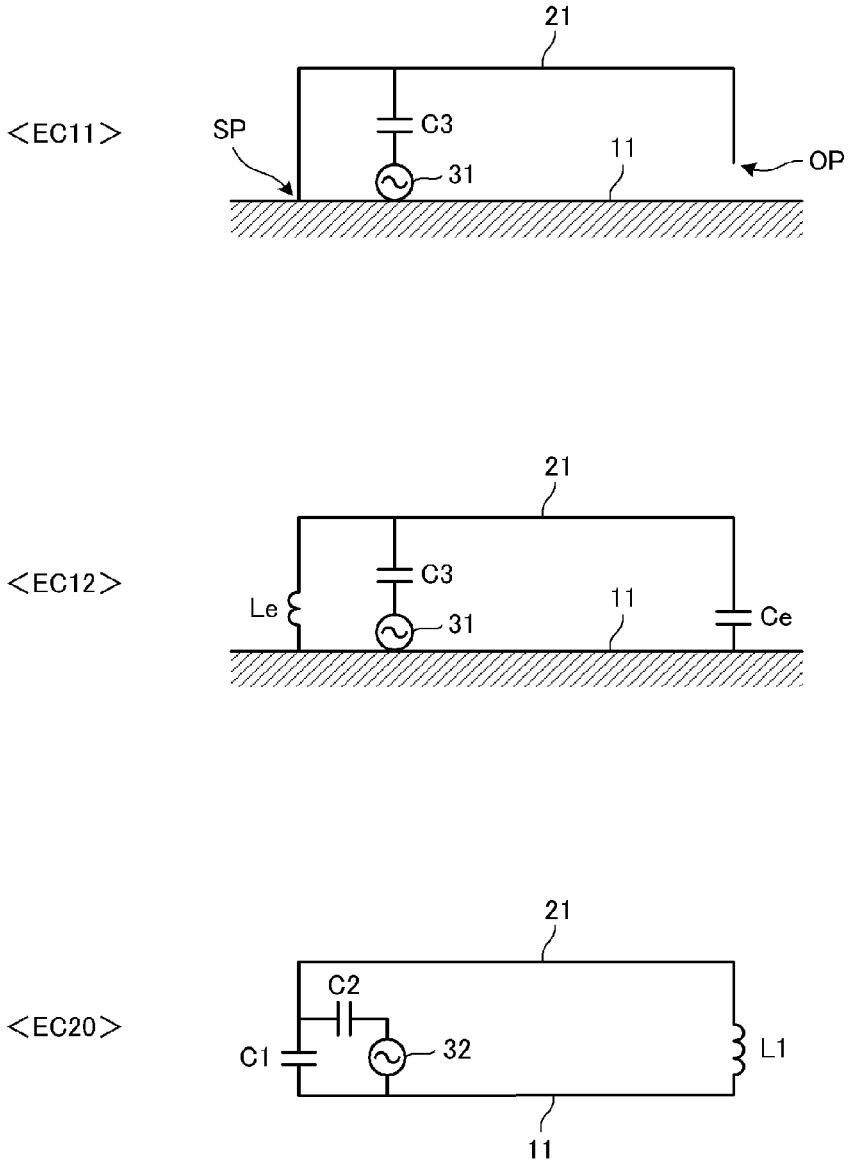
FIG. 2 illustrates equivalent circuit diagrams of the antenna device 101 in two frequency bands.

FIG. 2 illustrates equivalent circuit diagrams of the antenna device 101 in two frequency bands. In FIG. 2, equivalent circuits EC11 and EC12 correspond to equivalent circuit diagrams in the UHF band, and an equivalent circuit EC20 corresponds to an equivalent circuit diagram in the HF band.

The capacitor C1 illustrated in FIG. 1 equivalently enters a short-circuited state at a low impedance in the UHF band, and thus the first end of the radiation element 21 is grounded to the ground conductor 11, as indicated by a grounded end SP in the equivalent circuit EC11 illustrated in FIG. 2. Meanwhile, the inductor L1 illustrated in FIG. 1 equivalently enters an open state at a high impedance in the UHF band, and thus the second end of the radiation element 21 is left open, as indicated by an open end OP in the equivalent circuit EC11 illustrated in FIG. 2. With regard to the capacitor C1, the inductive reactance of the element becomes dominant in the UHF band, and thus the circuit can be expressed as if the radiation element 21 is grounded through an equivalent inductor Le, as indicated in the equivalent circuit EC12 illustrated in FIG. 2. Meanwhile, with regard to the inductor L1, the capacitive reactance of the element becomes dominant in the UHF band, and thus the circuit can be expressed as if an equivalent capacitor Ce has been connected between the open end of the radiation element 21 and the ground, as indicated in the equivalent circuit EC12 illustrated in FIG. 2.

The first feeder circuit 31 feeds a voltage to a predetermined feeding point on the radiation element 21. In the UHF band, the radiation element 21 resonates such that the field strength is maximized at the open end and the current strength is maximized at the grounded end SP. In other words, the length of the radiation element 21, the values of the equivalent inductor Le and the equivalent capacitor Ce, and so forth are determined so that the radiation element 21 resonates in the UHF band. It is to be noted that this radiation element 21 resonates in a fundamental mode in a low band and resonates in a higher mode in a high band within a frequency band ranging from 700 MHz to 2.4 GHz. In this manner, in the UHF band, the radiation element 21 and the ground conductor 11 define and function as an inverted F antenna that contributes to field emission. Although an inverted F antenna is illustrated as an example herein, the above can also be applied to a monopole antenna or the like in a similar manner. Furthermore, the above can also be applied to a patch antenna, such as a planar inverted F antenna (PIFA), in a similar manner.

In the meantime, in the HF band, as indicated in the equivalent circuit EC20 illustrated in FIG. 2, an LC resonant circuit is defined by the radiation element 21, an edge side of the ground conductor 11 that faces the radiation element 21, an inductance of the inductor L1, and a capacitance of the capacitor C1. The second feeder circuit 32 feeds communication signals of a second frequency to the respective ends of the capacitor C1 through the capacitor C2.

The aforementioned LC resonant circuit resonates in the HF band, and a resonant current flows through the radiation element 21 and the edge side of the ground conductor 11. In other words, the length of the radiation element 21, the values of the inductor L1 and the capacitor C1, and so forth are determined so that the LC resonant circuit resonates in the HF band. In this manner, in the HF band, a loop circuit defined by the radiation element 21 and the ground conductor 11 defines and functions as a loop antenna that contributes to magnetic field emission.

The capacitor C3 illustrated in FIG. 1 has a high impedance in the HF band (second frequency band), leading to a state in which equivalently the first feeder circuit 31 is not connected, and thus the first feeder circuit 31 does not affect communication in the HF band. In addition, in the UHF band (first frequency band), the first end of the radiation element is either equivalently grounded or grounded through a low inductance. Thus, a communication signal in the UHF band does not flow through the second feeder circuit 32, and the second feeder circuit 32 does not affect communication in the UHF band.

In this manner, the antenna device 101 functions as a communication antenna for the UHF band (first frequency band) and as a communication antenna for the HF band (second frequency band).

Figure 3:
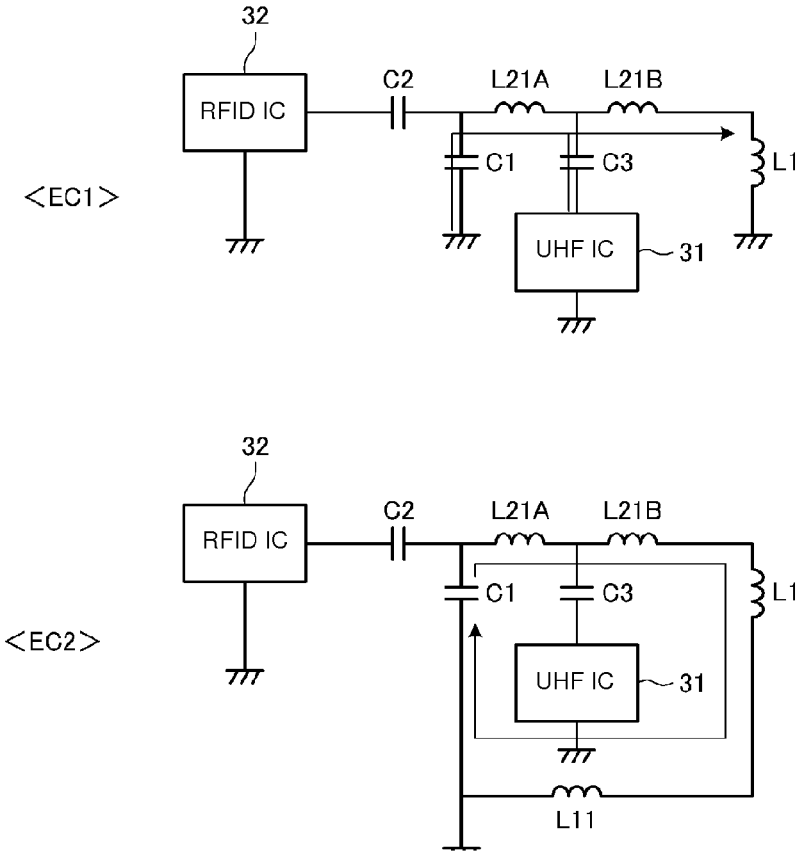
FIG. 3 illustrates equivalent circuit diagrams of lumped-parameter elements in the antenna device 101 according to the first preferred embodiment of the present invention.

FIG. 3 illustrates equivalent circuit diagrams of lumped-parameter elements in the antenna device 101 according to the first preferred embodiment. In FIG. 3, an equivalent circuit EC1 corresponds to an equivalent circuit diagram in the UHF band, and an equivalent circuit EC2 corresponds to an equivalent circuit diagram in the HF band. In FIG. 3, the radiation element 21 is represented by inductors L21A and L21B, and the ground conductor 11 is represented by an inductor L11.

As illustrated in FIG. 3, in the UHF band, a current flows through the equivalent circuit EC1 as indicated by an arrow, and the equivalent circuit EC1 thus defines and functions as an inverted F antenna. In the HF band, a current flows through the equivalent circuit EC2 as indicated by an arrow, and the equivalent circuit EC2 thus functions as a loop antenna.

Figure 4:
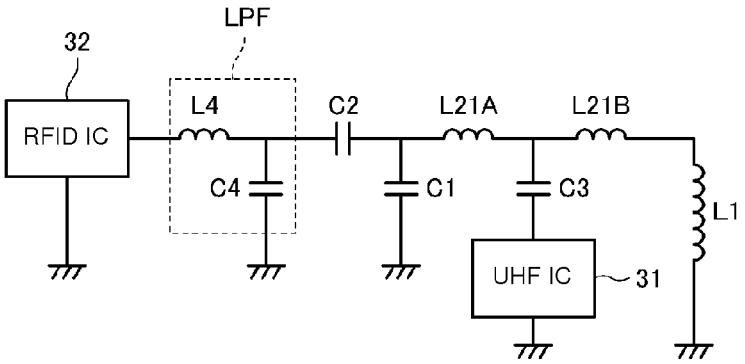
FIG. 4 illustrates an equivalent circuit diagram of a case in which a low pass filter LPF is provided at an input/output portion of a second feeder circuit 32.

FIG. 4 illustrates an equivalent circuit diagram of a case in which a low pass filter LPF is provided at an input/output portion of the second feeder circuit 32. In the example illustrated in FIG. 4, the low pass filter LPF including an inductor L4 and a capacitor C4 is provided between the feeder circuit 32 including an RFID IC and the capacitor C2. Other configurations preferably are identical to those of the equivalent circuit CE1 illustrated in FIG. 3. The low pass filter LPF removes a high frequency noise component outputted from the RFID IC. Through this, an influence of a noise component on the communication in the UHF band and the communication in the HF band are reduced.

Second Preferred Embodiment

In a second preferred embodiment of the present invention, an example in which the second feeder circuit carries out a balanced feed to an antenna will be illustrated.

Figure 5:
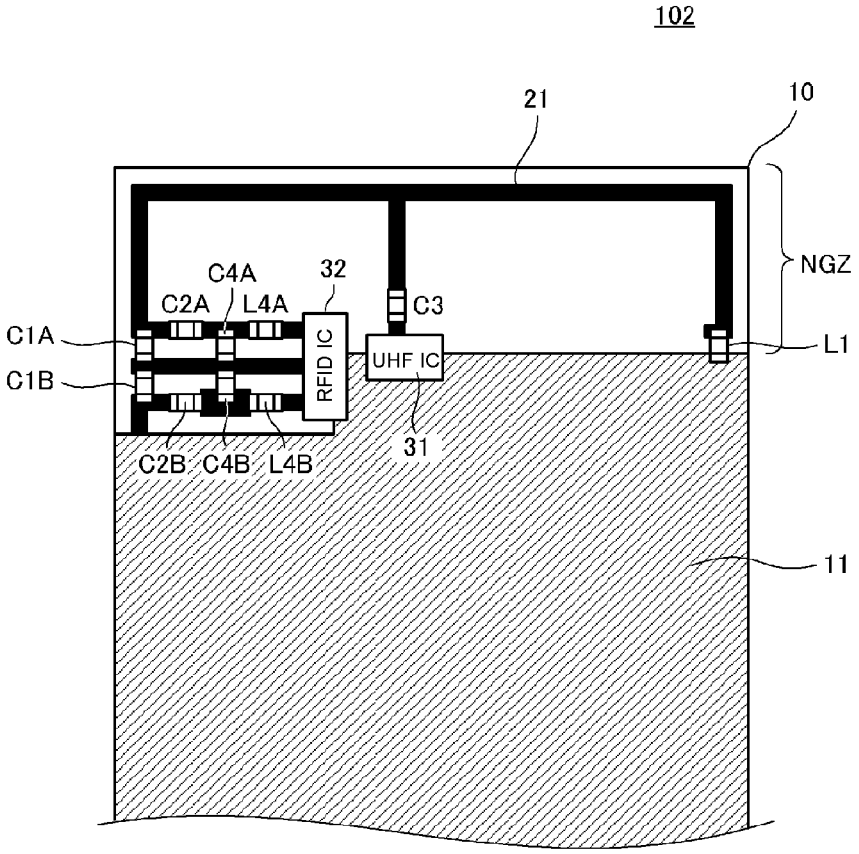
FIG. 5 is a plan view of a primary portion of an antenna device 102 according to a second preferred embodiment of the present invention.

FIG. 5 is a plan view of a primary portion of an antenna device 102 according to the second preferred embodiment. This antenna device 102 is provided on the board 10. The board 10 includes a region where the ground conductor 11 is located and the non-ground region NGZ where the ground conductor is not located. The square bracket-shaped radiation element 21 is located in the non-ground region NGZ. A circuit that includes a plurality of chip components and the second feeder circuit 32 is provided between the first end of the radiation element 21 and the ground conductor 11. The chip inductor L1 is connected between the second end of the radiation element 21 and the ground conductor 11. Other configurations are preferably similar to those illustrated in FIG. 1.

Figure 6:
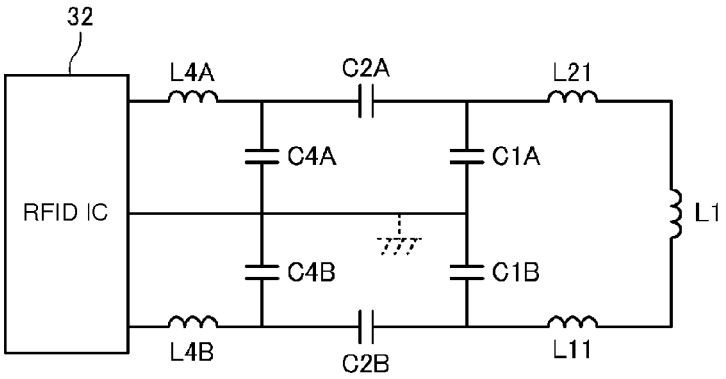
FIG. 6 illustrates an equivalent circuit diagram of the antenna device in an HF band according to the second preferred embodiment of the present invention.

FIG. 6 illustrates an equivalent circuit diagram of the antenna device 102 in the HF band according to the second preferred embodiment. In FIG. 6, the radiation element 21 is represented by an inductor L21, and the ground conductor 11 is represented by the inductor L11. An LC resonant circuit is defined by these inductors L21, L11, and L1 and capacitors CIA and C1B.

A low pass filter including inductors L4A and L4B and capacitors C4A and C4B is provided between the second feeder circuit 32 and capacitors C2A and C2B. The second feeder circuit 32 feeds balanced communication signals of the second frequency to the respective ends of the capacitors CIA and C1B through the aforementioned low pass filter and the capacitors C2A and C2B. In this manner, a balanced feeder circuit can be applied as well.

Third Preferred Embodiment

Figure 7:
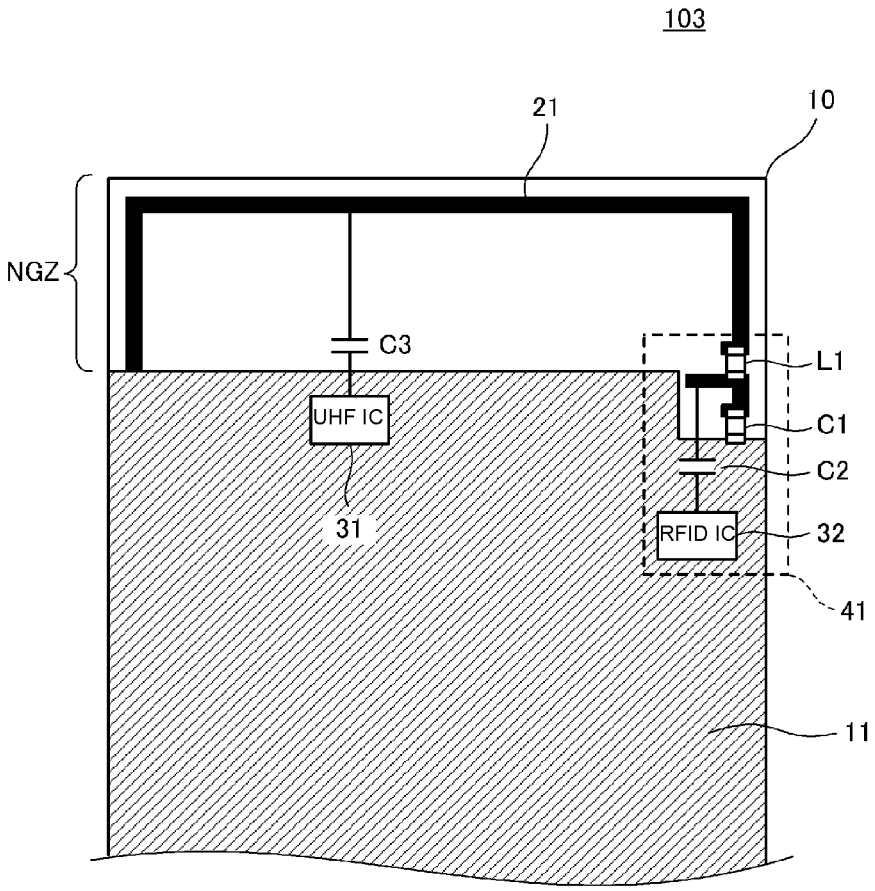
FIG. 7 is a plan view of a primary portion of an antenna device 103 according to a third preferred embodiment of the present invention.

FIG. 7 is a plan view of a primary portion of an antenna device 103 according to a third preferred embodiment of the present invention. This antenna device 103 is provided on the board 10. The board 10 includes a region where the ground conductor 11 is located and the non-ground region NGZ where the ground conductor is not located. The square bracket-shaped radiation element 21 is located in the non-ground region NGZ. The first end of the radiation element 21 is directly grounded to the ground conductor 11. The chip inductor L1 and the chip capacitor C1 are connected in series between the second end of the radiation element 21 and the ground conductor 11.

On the board 10, the first feeder circuit 31 is defined by the UHF band IC, and the second feeder circuit 32 is defined by the HF band RFID IC.

The input/output portion of the first feeder circuit is connected to a predetermined feeding point of the radiation element 21 through the capacitor C3. Meanwhile, the input/output portion of the second feeder circuit 32 is connected to a connection portion between the inductor L1 and the capacitor C1 through the capacitor C2.

The inductor L1, the capacitors C1 and C2, and the second feeder circuit 32 define a single RF module 41, and this RF module 41 is mounted on the board 10.

Figure 8:
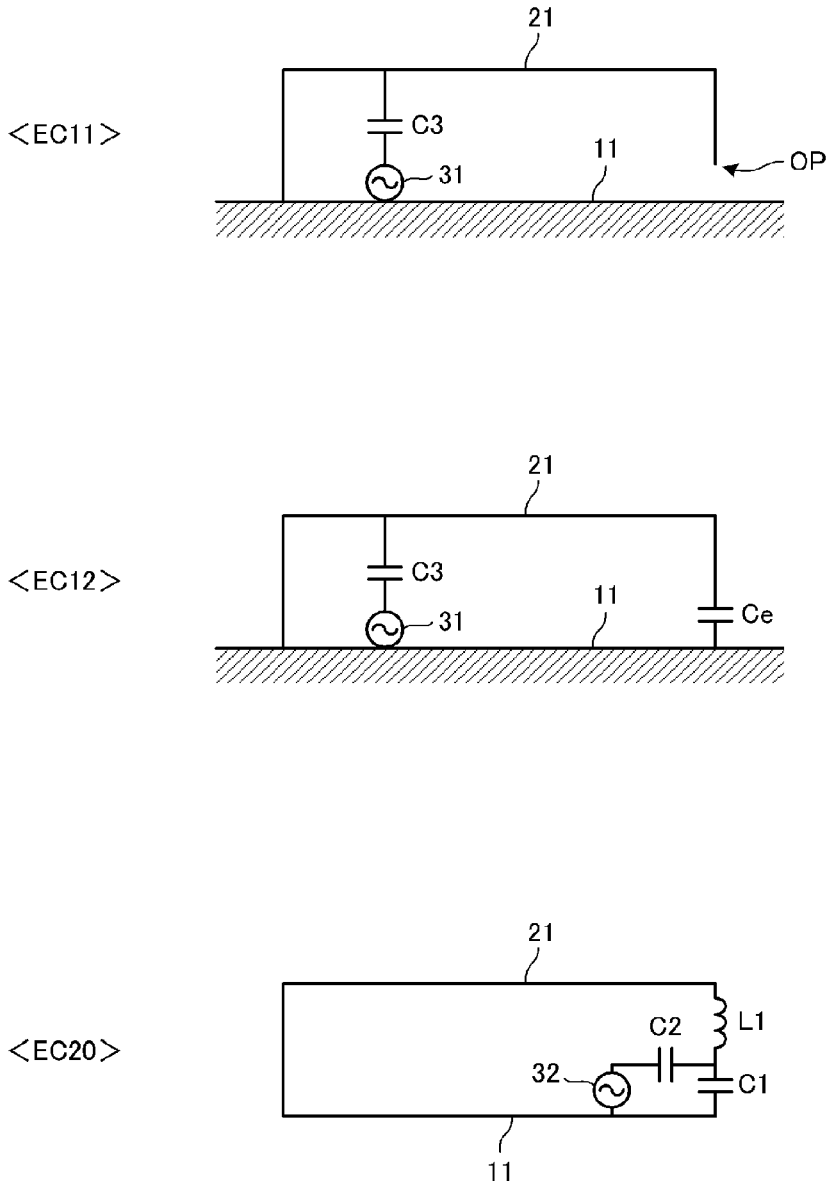
FIG. 8 illustrates equivalent circuit diagrams of the antenna device in two frequency bands according to the third preferred embodiment of the present invention.

FIG. 8 illustrates equivalent circuit diagrams of the antenna device 103 in two frequency bands. In FIG. 8, equivalent circuits EC11 and EC12 correspond to equivalent circuit diagrams in the UHF band, and an equivalent circuit EC20 corresponds to an equivalent circuit diagram in the HF band.

The capacitor C1 illustrated in FIG. 7 equivalently enters a short-circuited state at a low impedance in the UHF band, whereas the inductor L1 illustrated in FIG. 7 equivalently enters an open state at a high impedance in the UHF band. Therefore, as indicated by the open end OP in the equivalent circuit EC11 illustrated in FIG. 8, the second end of the radiation element 21 is left open. When a capacitance component of the capacitor C1 and the inductor L1 in the UHF band is represented by the equivalent capacitor Ce, the circuit can be expressed as if the equivalent capacitor Ce is connected between the open end of the radiation element 21 and the ground, as indicated in the equivalent circuit EC12 illustrated in FIG. 8.

The first feeder circuit 31 feeds a voltage to a predetermined feeding point on the radiation element 21. In the UHF band, the radiation element 21 resonates such that the field strength is maximized at the open end and the current strength is maximized at the grounded end SP. In other words, the length of the radiation element 21, the value of the equivalent capacitor Ce, and so forth are determined so that the radiation element 21 resonates in the UHF band. In this manner, in the UHF band, the radiation element 21 and the ground conductor 11 define and function as an inverted F antenna that contributes to field emission.

In the meantime, in the HF band, as indicated in the equivalent circuit EC20 illustrated in FIG. 8, an LC resonant circuit is defined by the radiation element 21, an edge side of the ground conductor 11 that faces the radiation element 21, an inductance of the inductor L1, and a capacitance of the capacitor C1. The second feeder circuit 32 feeds communication signals of the second frequency to the respective ends of the capacitor C1 through the capacitor C2.

The aforementioned LC resonant circuit resonates in the HF band, and a resonant current flows through the radiation element 21 and the edge side of the ground conductor 11. In other words, the length of the radiation element 21, the values of the inductor L1 and the capacitor C1, and so forth are determined so that the LC resonant circuit resonates in the HF band. In this manner, in the HF band, a loop circuit defined by the radiation element 21 and the ground conductor 11 defines and functions as a loop antenna that contributes to magnetic field emission.

The capacitor C3 illustrated in FIG. 7 has a high impedance in the HF band (second frequency band), leading to a state in which equivalently the first feeder circuit 31 is not connected, and thus the first feeder circuit 31 does not affect communication in the HF band. Meanwhile, in the UHF band (first frequency band), the first end of the radiation element 21 is either equivalently grounded or grounded through a low inductance. Thus, a communication signal in the UHF band does not flow through the second feeder circuit 32, and the second feeder circuit 32 does not affect communication in the UHF band.

In this manner, the antenna device 103 defines and functions as a communication antenna for the UHF band (first frequency band) and as a communication antenna for the HF band (second frequency band).

Fourth Preferred Embodiment

Figure 9:
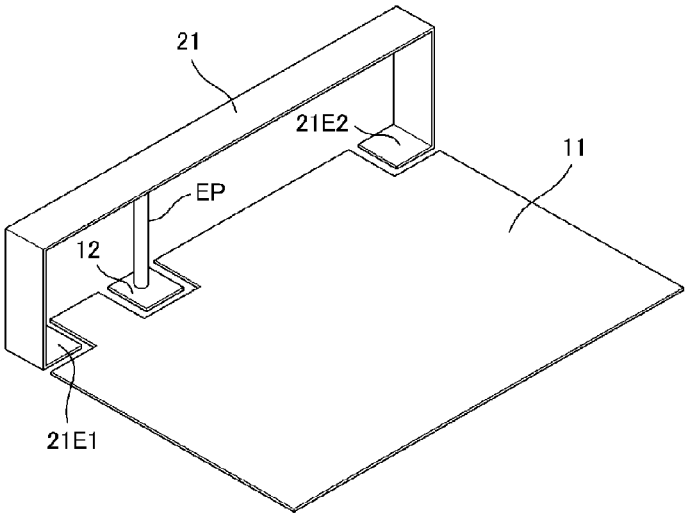
FIG. 9 illustrates a structure of, in particular, a radiation element 21 of an antenna device according to a fourth preferred embodiment of the present invention.

FIG. 9 illustrates, in particular, a structure of the radiation element 21 of an antenna device according to a fourth preferred embodiment of the present invention.

While an example in which a radiation element defined by a conductive pattern is provided on a board has been illustrated in the first through third preferred embodiments, the radiation element 21 may be defined by a metal plate, as illustrated in FIG. 9. In addition, the loop plane of the loop circuit defined by the radiation element 21 and the ground conductor does not need to lie along the plane of the ground conductor 11 and does not need to be parallel with the plane of the ground conductor 11. As illustrated in FIG. 9, the loop plane may be perpendicular or substantially perpendicular to the plane of the ground conductor 11.

The ground conductor 11 does not need to be defined by a conductive pattern on the board, either, and may be defined, for example, by a metal plate. Furthermore, a metalized housing may be used as part of the ground conductor.

In the example illustrated in FIG. 9, a gap is preferably provided between each of a first end 21E1 and a second end 21E2 of the radiation element 21 and the ground conductor 11. The chip capacitor C1 or the chip inductor L1 illustrated in FIG. 1 may, for example, be provided in the gap.

In addition, in the example illustrated in FIG. 9, a feeder pin EP, such as a spring pin, is provided so as to project from an electrode 12 that is electrically separated from the ground conductor 11, and this feeder pin EP abuts against the radiation element 21 at a predetermined position thereof and is fed with a voltage.

Fifth Preferred Embodiment

Figure 10:
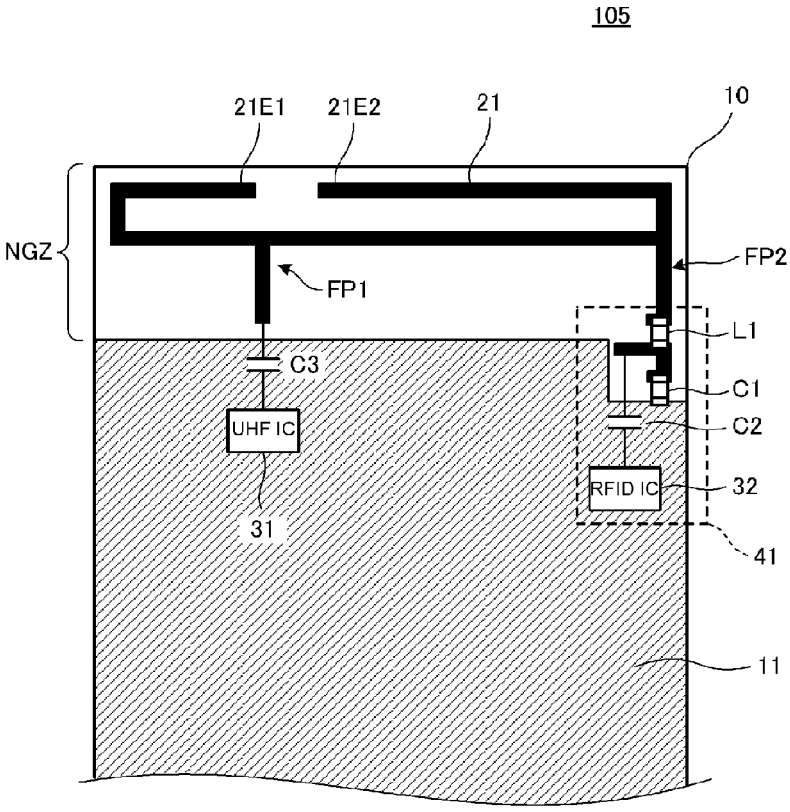
FIG. 10 is a plan view of a primary portion of an antenna device 105 according to a fifth preferred embodiment of the present invention.

FIG. 10 is a plan view of a primary portion of an antenna device 105 according to a fifth preferred embodiment of the present invention. A C-shaped radiation element 21 is provided in the non-ground region NGZ of the board 10. The chip inductor L1 and the chip capacitor C1 are connected in series between one end FP2 of a portion of the radiation element 21 that faces the edge side of the ground conductor 11 and the ground conductor 11.

On the board 10, the first feeder circuit 31 is defined by the UHF band IC, and the second feeder circuit 32 is defined by the HF band RFID IC.

The input/output portion of the first feeder circuit 31 is connected to a predetermined feeding point FP1 of the radiation element 21 through the capacitor C3. Meanwhile, the input/output portion of the second feeder circuit 32 is connected to a connection portion between the inductor L1 and the capacitor C1 through the capacitor C2.

The inductor L1, the capacitors C1 and C2, and the second feeder circuit 32 define the single RF module 41, and this RF module 41 is mounted on the board 10.

The line length from the feeding point FP1 to the first end 21E1 of the radiation element 21 differs from the line length from the feeding point FP1 to the second end 21E2. The radiation element 21 resonates in two frequency bands including a low band and a high band within a frequency band ranging from 700 MHz to 2.4 GHz. The aforementioned two resonant frequencies are adjusted through a capacitance generated between the first end 21E1 and the second end 21E2 of the radiation element 21 as well.

Of the radiation element 21, a portion between the feeding point FP1 of the UHF band and the node FP2 of the module 41 constitutes part of the HF band antenna loop.

Sixth Preferred Embodiment

Figure 11:
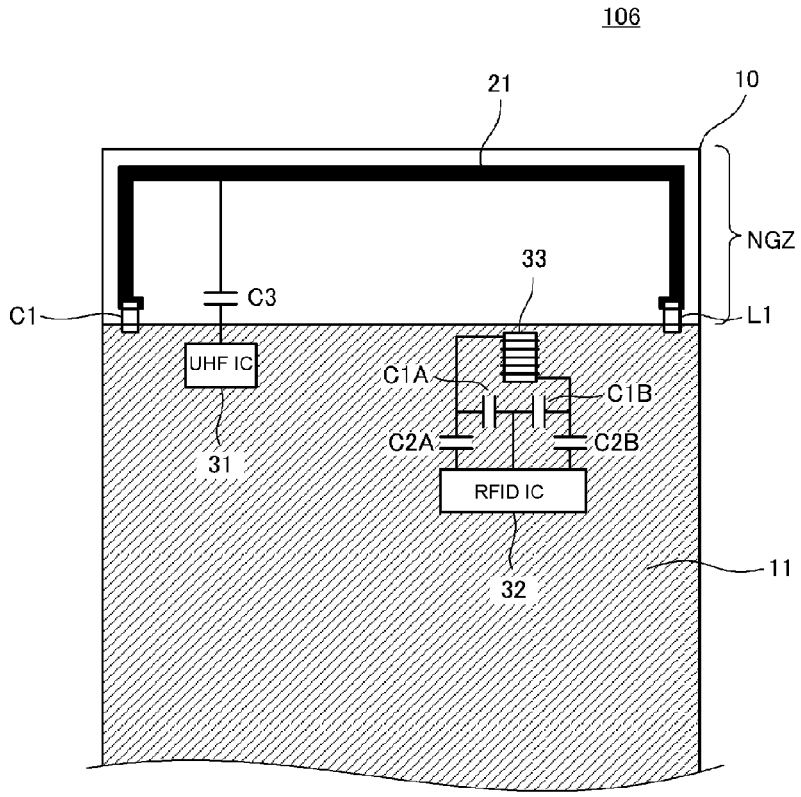
FIG. 11 is a plan view of a primary portion of an antenna device 106 according to a sixth preferred embodiment of the present invention.

FIG. 11 is a plan view of a primary portion of an antenna device 106 according to a sixth preferred embodiment of the present invention. The square bracket-shaped radiation element 21 is located in the non-ground region NGZ of the board 10. The chip capacitor C1 is connected between the first end of the radiation element 21 and the ground conductor 11, and the chip inductor L1 is connected between the second end of the radiation element 21 and the ground conductor 11.

On the board 10, the first feeder circuit 31 is defined by the UHF band IC, and the second feeder circuit 32 is defined by the HF band RFID IC.

The input/output portion of the first feeder circuit 31 is connected to a predetermined feeding point of the radiation element 21 through the capacitor C3. The feeder circuit 32 is a balanced input/output type RFID IC, and a feeder coil 33 is connected to the input/output portion of the feeder circuit 32 through the capacitors. The feeder coil 33 is a ferrite chip antenna in which a coil is wound around a ferrite core. The feeder coil 33 is disposed such that the coil axis thereof is directed toward the radiation element 21. The feeder circuit 32, the capacitors, and the feeder coil 33 may be modularized, and the obtained module may be mounted on the board 10.

In the HF band, an LC resonant loop is defined by the radiation element 21, an edge side of the ground conductor 11, the inductor L1, and the capacitor C1. The feeder coil 33 undergoes magnetic field coupling with this loop.

Figure 12:
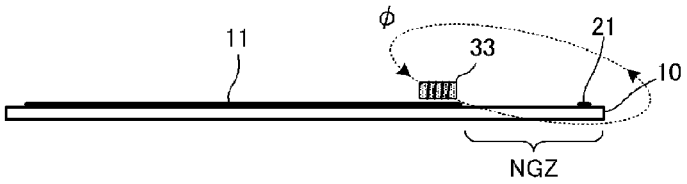
FIG. 12 illustrates a state of magnetic field coupling between a feeder coil 33 and the radiation element 21.

FIG. 12 illustrates a state of magnetic field coupling between the feeder coil 33 and the radiation element 21. The feeder coil 33 is disposed at an edge of the ground conductor 11, and the magnetic flux that passes through the feeder coil 33 makes a circle so as to avoid the ground conductor 11. Thus, this magnetic flux is likely to link with the radiation element 21 located in the non-ground region NGZ of the board 10.

Figure 13:
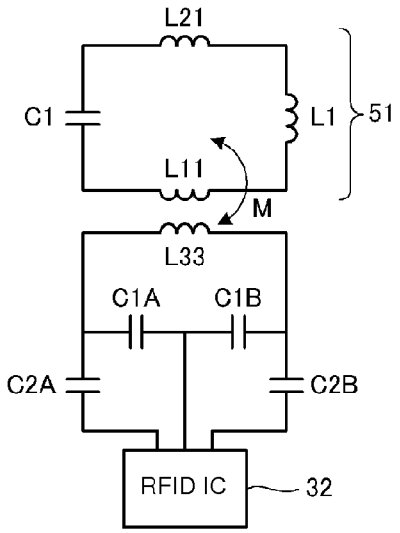
FIG. 13 illustrates an equivalent circuit diagram of the antenna device in the HF band according to the sixth preferred embodiment of the present invention.

FIG. 13 illustrates an equivalent circuit diagram of the antenna device 106 in the HF band. In FIG. 13, the radiation element 21 is represented by the inductor L21, and the edge side of the ground conductor 11 is represented by the inductor L11. A series circuit including the capacitors C1A and C1B is connected to the feeder coil 33, and thus an LC resonant circuit is provided. The second feeder circuit 32 feeds a communication signal of the HF band to this LC resonant circuit through the capacitors C2A and C2B.

The LC resonant loop including the radiation element 21, the edge side of the ground conductor 11, the inductor L1, and the capacitor C1 defines and functions as a booster antenna 51.

It is to be noted that, as illustrated in FIG. 7, the first end of the radiation element 21 may be grounded, and an inductor and a capacitor may be disposed at the second end. Alternatively, the second end may be grounded, and an inductor and a capacitor may be disposed at the first end.

In this preferred embodiment, a feeder circuit of the HF band is not directly connected to the radiation element 21, and thus the mounting position of the feeder coil 33 is capable of being set highly flexibly, and a pattern to be provided on the board 10 is simplified as well.

Seventh Preferred Embodiment

Figure 14:
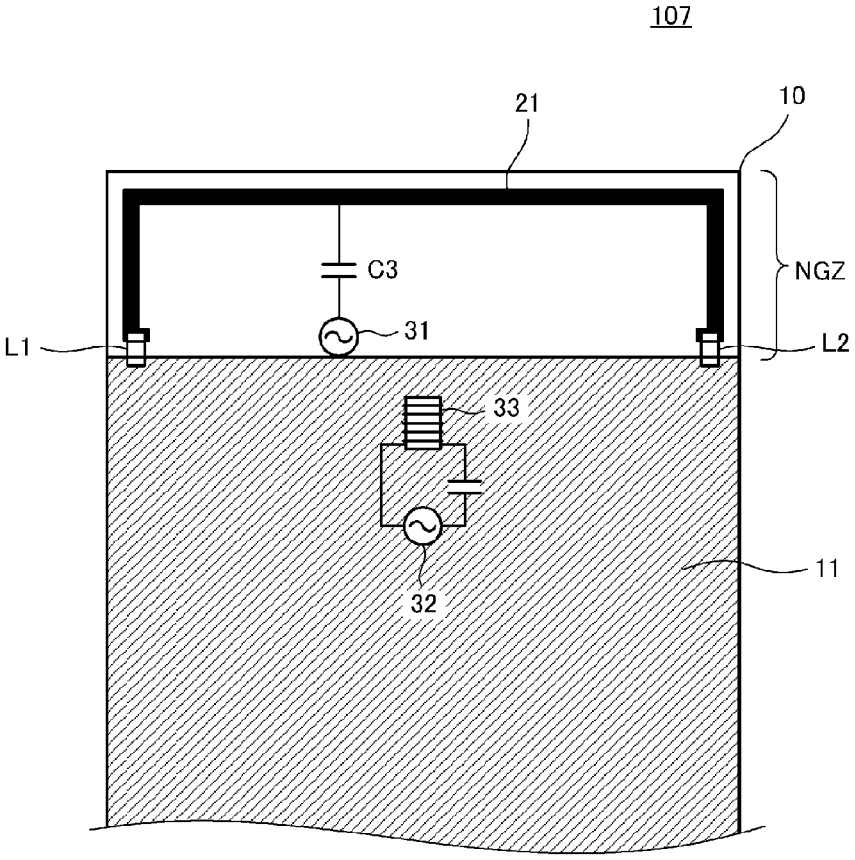
FIG. 14 is a plan view of a primary portion of an antenna device 107 according to a seventh preferred embodiment of the present invention.

FIG. 14 is a plan view of a primary portion of an antenna device 107 according to a seventh preferred embodiment of the present invention. The square bracket-shaped radiation element 21 is located in the non-ground region NGZ of the board 10. The chip inductor L1 is connected between the first end of the radiation element 21 and the ground conductor 11, and a chip inductor L2 is connected between the second end of the radiation element 21 and the ground conductor 11.

On the board 10, the first feeder circuit 31 is defined by the UHF band IC, and the second feeder circuit 32 is defined by the HF band RFID IC.

The input/output portion of the first feeder circuit 31 is connected to a predetermined feeding point of the radiation element 21 through the capacitor C3. The feeder coil 33 is connected to the input/output portion of the feeder circuit 32 through a capacitor. The feeder coil 33 is a ferrite chip antenna in which a coil is wound around a ferrite core, and is disposed such that the coil axis thereof is directed toward the radiation element 21.

Figure 15:
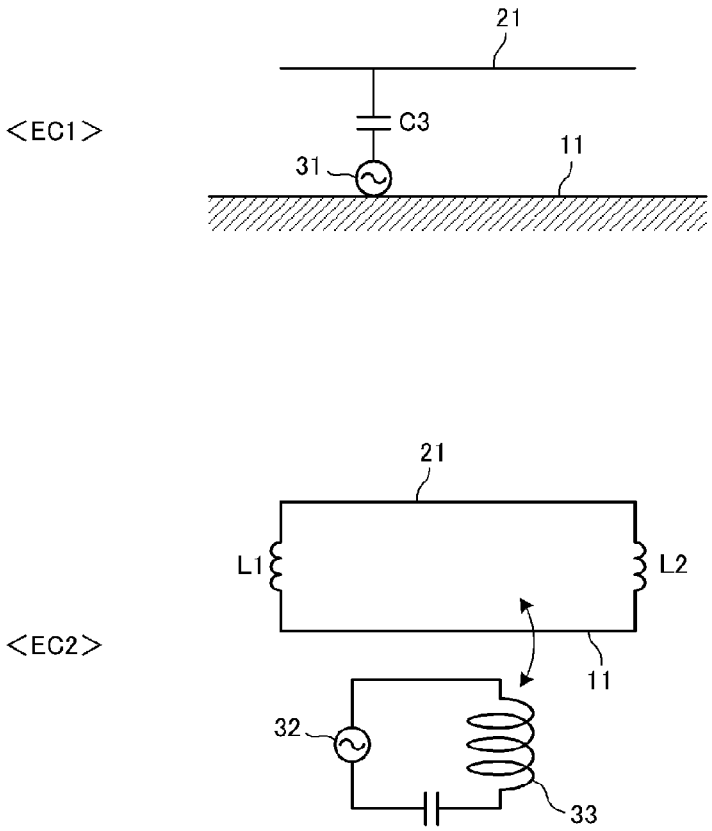
FIG. 15 illustrates equivalent circuit diagrams of the antenna device in two frequency bands according to the seventh preferred embodiment of the present invention.

FIG. 15 illustrates equivalent circuit diagrams of the antenna device 107 in two frequency bands. In FIG. 15, an equivalent circuit EC1 corresponds to an equivalent circuit diagram in the UHF band, and an equivalent circuit EC2 corresponds to an equivalent circuit diagram in the HF band. In the UHF band, the inductors L1 and L2 become a high impedance. Thus, the two ends of the radiation element 21 are equivalently left open, and the radiation element 21 defines and functions as a field emission antenna in the UHF band.

In a case in which a feeder circuit of the HF band is not directly connected to the radiation element 21, as in the above example, the two ends of the radiation element 21 may be grounded to the ground conductor 11 through the inductors. Thus, in the HF band, a loop circuit is defined by the radiation element 21, an edge side of the ground conductor 11, and the inductors L1 and L2. The feeder coil 33 undergoes magnetic field coupling with this loop circuit. Thus, the loop circuit defines and functions as a booster antenna.

Eighth Preferred Embodiment

Figure 16:
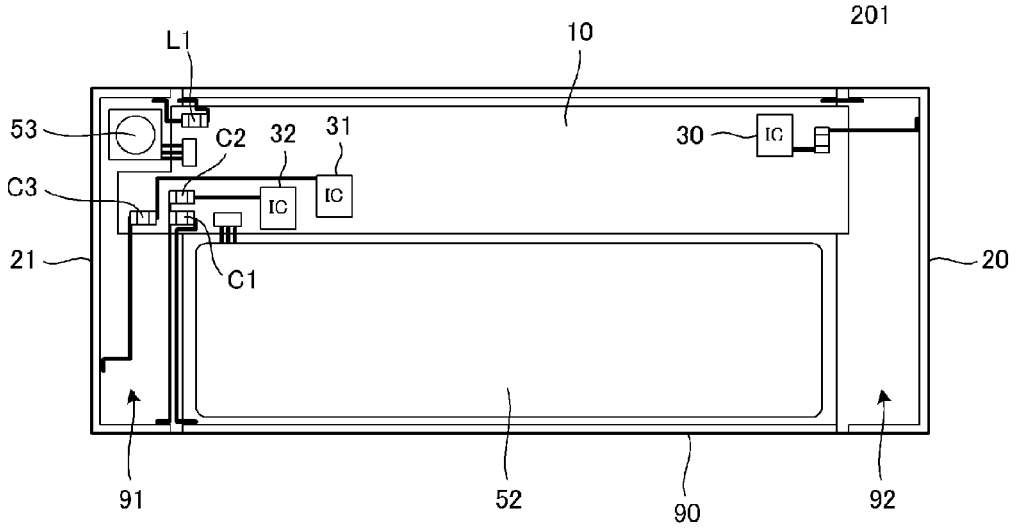
FIG. 16 is a plan view of a communication terminal apparatus 201 that includes an antenna device according to an eighth preferred embodiment of the present invention, in a state in which a lower housing is removed.

FIG. 16 is a plan view of a communication terminal apparatus 201 that includes an antenna device according to an eighth preferred embodiment of the present invention, in a state in which a lower housing is removed. This communication terminal apparatus 201 is a preferred embodiment of an "electronic apparatus". The housing of the communication terminal apparatus 201 is defined primarily by a metalized housing portion 90, and radiation elements 21 and 20 defined by a molded metal plate are provided, respectively, in nonmetal regions 91 and 92 at two end portions of the metalized housing portion 90. A battery pack 52 is housed in the metalized housing portion 90. A feeder circuit 30, the first feeder circuit 31, the second feeder circuit 32, the chip capacitors C1, C2, and C3, the chip inductor L1, a camera module 53, and so forth are mounted on the board 10. The metalized housing portion 90 is electrically connected to the ground of the board 10. The aforementioned elements are connected to the radiation element 21 in a manner as illustrated in FIG. 1.

In the UHF band, the radiation element 21 and the ground conductor 11 define and function as an inverted F antenna that contributes to field emission. In the HF band, a loop defined by the radiation element 21 and an edge side of the metalized housing portion 90 defines and functions as a loop antenna that contributes to magnetic field emission.

It is to be noted that, in the example illustrated in FIG. 16, the radiation element 20 is preferably used as a main antenna for cellular communication, and the radiation element 21 preferably is used as a sub-antenna for cellular communication (in the UHF band), for example.

Ninth Preferred Embodiment

Figure 17:
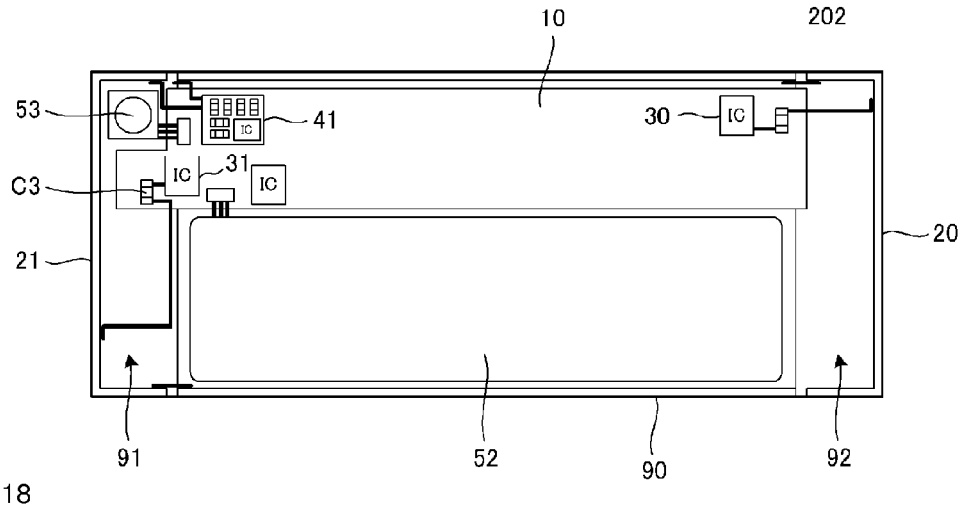
FIG. 17 is a plan view of a communication terminal apparatus 202 that includes an antenna device according to a ninth preferred embodiment of the present invention, in a state in which a lower housing is removed.

FIG. 17 is a plan view of a communication terminal apparatus 202 that includes an antenna device according to a ninth preferred embodiment of the present invention, in a state in which a lower housing is removed. This communication terminal apparatus 202 is a preferred embodiment of an "electronic apparatus". The housing of the communication terminal apparatus 202 is defined primarily by the metalized housing portion 90, and the radiation elements 21 and 20 defined by a molded metal plate are formed, respectively, in the nonmetal regions 91 and 92 at the two end portions of the metalized housing portion 90. The battery pack 52 is housed in the metalized housing portion 90. The feeder circuit 30, the first feeder circuit 31, the chip capacitor C3, the RF module 41, the camera module 53, and so forth are mounted on the board 10 of the communication terminal apparatus 202. The metalized housing portion 90 is electrically connected to the ground of the board 10. The aforementioned elements are connected to the radiation element 21 in a manner as illustrated in FIG. 7.

In the UHF band, the radiation element 21 and the ground conductor 11 define and function as an inverted F antenna that contributes to field emission. In the HF band, a loop defined by the radiation element 21 and an edge side of the metalized housing portion 90 defines and functions as a loop antenna that contributes to magnetic field emission.

Tenth Preferred Embodiment

A tenth preferred embodiment of the present invention corresponds to an example in which a loop that includes two radiation elements is used as a loop antenna for the HF band.

Figure 18:
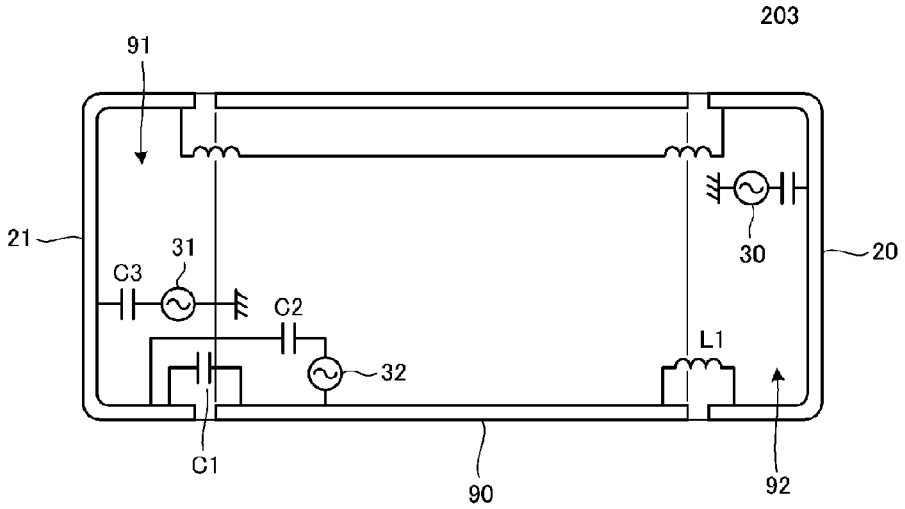
FIG. 18 is a plan view of a communication terminal apparatus 203 according to a tenth preferred embodiment of the present invention, in a state in which a lower housing is removed.

FIG. 18 is a plan view of a communication terminal apparatus 203 according to the tenth preferred embodiment, in a state in which a lower housing is removed. The housing of the communication terminal apparatus 203 is defined primarily by the metalized housing portion 90, and the radiation elements 21 and 20 defined by a molded metal plate are provided, respectively, in the nonmetal regions 91 and 92 at the two end portions of the metalized housing portion 90. The feeder circuit 30, the first feeder circuit 31, the second feeder circuit 32, the chip capacitors C1, C2, and C3, the chip inductor L1, and so forth are provided inside the housing. In FIG. 18, the board is omitted from the drawing.

The capacitor C1 is connected between the first end of the radiation element 21 and the metalized housing portion 90. The second end of the radiation element 21 is connected with a first end of the radiation element 20 through inductors and a line. The inductor L1 is connected between a second end of the radiation element 20 and the metalized housing portion 90. In this manner, a loop is defined by the radiation elements 20 and 21, the metalized housing portion 90, the aforementioned inductors, and the line, and an LC resonant circuit is defined by the loop and the capacitor C1. The second feeder circuit 32 feeds to the LC resonant circuit through the capacitor C2. The first feeder circuit 31 feeds to a feeding point of the radiation element 21 through the capacitor C3. In a similar manner, the feeder circuit 30 feeds to a feeding point of the radiation element 20 through a capacitor.

In this manner, the loop antenna for the HF band having a large loop diameter (loop length) is provided.

Eleventh Preferred Embodiment

It is preferable that a first reactance element connected between the radiation element and the ground conductor be ideally an element that does not undergo self resonance or have a very high self resonant frequency. In reality, however, a reactance element includes a parasitic component and thus undergoes self resonance. Illustrated in the present preferred embodiment is an example in which an issue of self resonance is resolved by incorporating a reactance element that undergoes self resonance at a predetermined frequency in a case in which the self resonant frequency of the first reactance element falls within a used frequency band.

Figure 19:
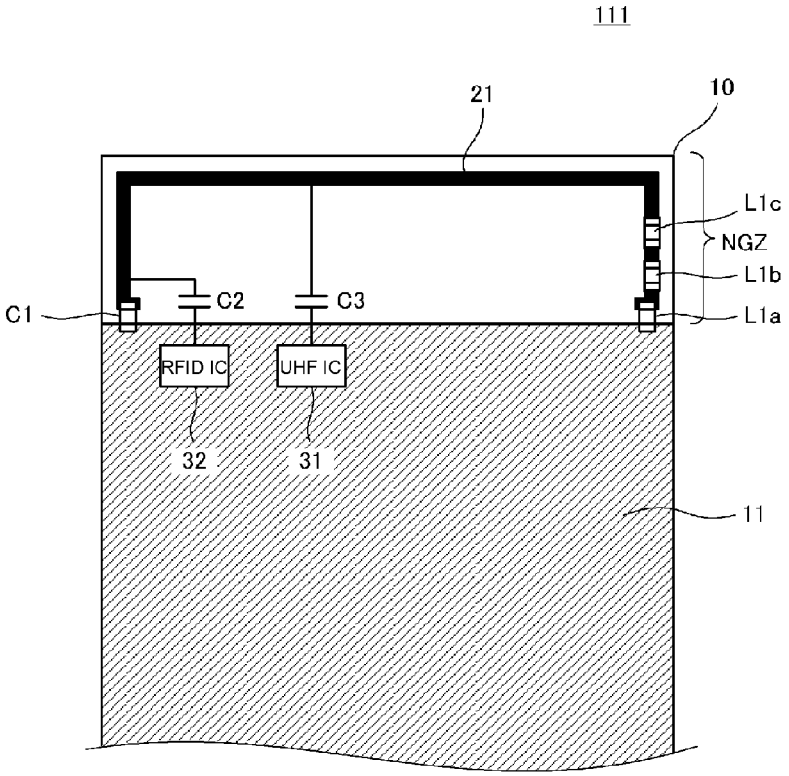
FIG. 19 is a plan view of a primary portion of an antenna device 111 according to an eleventh preferred embodiment of the present invention.

FIG. 19 is a plan view of a primary portion of an antenna device 111 according to an eleventh preferred embodiment of the present invention. This antenna device 111 is provided on the board 10. The board 10 includes a region where the ground conductor 11 is located and the non-ground region NGZ where the ground conductor 11 is not located. The square bracket-shaped radiation element 21 is located in the non-ground region NGZ. Specifically, this radiation element 21 includes a portion that is parallel or substantially parallel to an edge side of the ground conductor 11 and portions that extend from the parallel portion toward the ground conductor. The chip capacitor (capacitor) C1 is mounted between the first end of the radiation element 21 and the ground conductor 11 and is electrically connected therebetween. In addition, chip inductors L1*a*, L1*b*, and L1*c* are mounted between the second end of the radiation element 21 and the ground conductor 11 and are electrically connected therebetween. The chip inductors L1*a*, L1*b*, and L1*c* define the first reactance element, and the capacitor C1 corresponds to a second reactance element.

Unlike the antenna device 101 illustrated in FIG. 1 in the first preferred embodiment, the first reactance element preferably includes a series circuit including a plurality of reactance elements. In this example, the first reactance element preferably includes a series circuit including the three chip inductors L1*a*, L1*b*, and L1*c*. Other configurations are preferably similar to those of the antenna device 101 illustrated in the first preferred embodiment.

Figure 20:
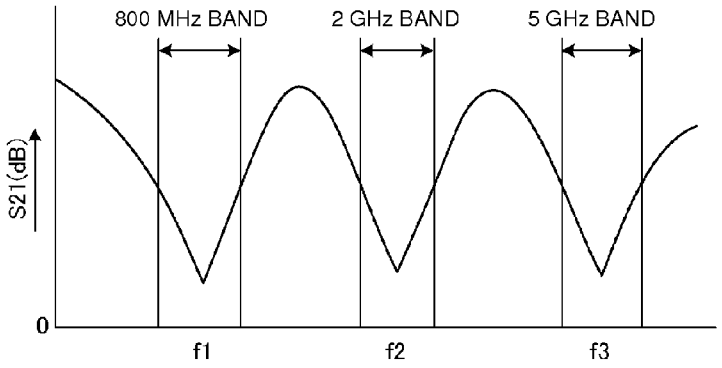
FIG. 20 illustrates frequency characteristics of an insertion loss (S21) of a first reactance element as seen from a feeder circuit.

FIG. 20 illustrates frequency characteristics of an insertion loss (S21) of the first reactance element as seen from the first feeder circuit 31. Troughs of the insertion loss in the 800 MHz band, the 2 GHz band, and the 5 GHz band indicated in FIG. 20 are caused by the three inductors L1*a*, L1*b*, and L1*c*. In other words, the chip inductors L1*a*, L1*b*, and L1*c* can be considered as a circuit in which their capacitances, which are parasitic components, are connected in parallel to an inductor. In this example, the self resonant frequencies of the chip inductors L1*a*, L1*b*, and L1*c* are, respectively, 800 MHz, 2 GHz, and 5 GHz. Thus, the chip inductors L1*a*, L1*b*, and L1*c* become a high impedance (equivalently open state) at the respective self resonant frequencies. Therefore, the second end (side at which the chip inductors L1*a*, L1*b*, and L1*c*, which define the first reactance element, are provided) of the radiation element 21 becomes equivalently open in each of the frequency bands. As a result, as indicated in FIG. 20, in the UHF band (first frequency band), the first reactance element does not hinder the function of the radiation element as an antenna in each of the frequency bands, and the radiation element 21 thus functions as an antenna in a broad band.

In this manner, by providing a series circuit including a plurality of chip inductors having mutually different self resonant frequencies as the first reactance element, in the UHF band (first frequency band), the frequency band in which the radiation element functions as an antenna is broadened.

It is to be noted that, although three chip inductors are preferably provided in the example illustrated in FIG. 19, the number of the chip inductors may be two or four or more as long as the reactance element undergoes self resonance at least at a predetermined frequency. In addition, the reactance element is not limited to a chip inductor, and the various preferred embodiments can be applied in a similar manner as long as a given reactance element undergoes self resonance at a predetermined frequency.

Although each of the preferred embodiments described above illustrates an antenna device that is preferably shared by the UHF band antenna and the HF band antenna, the present invention is not limited to the frequency bands. For example, preferred embodiments of the present invention can be applied to a frequency band other than the UHF and the HF, such as an antenna for a W-LAN in a 5 GHz band or for receiving FM broadcasting or AM broadcasting, for example.

In addition, in particular, the loop circuit defined by the radiation element, the reactance element, and the ground conductor can be applied to an antenna for electric power transmission not only for communication but also for a magnetic resonance type wireless charger.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna device comprising:

a radiation element of an electric field type antenna;

a ground conductor opposing the radiation element; and a feeder coil to which a feeder circuit of a communication signal of a second frequency band is connected and that is configured to achieve magnetic field coupling with a loop circuit of a magnetic field type antenna; wherein at least one first reactance element is connected between the radiation element and the ground conductor;

the radiation element, the at least one first reactance element, and the ground conductor define the loop circuit; and the radiation element is an antenna element configured for a first frequency band, and the loop circuit is an antenna element configured for the second frequency band that is lower than the first frequency band.

2. The antenna device according to claim 1, wherein the first reactance element is an element with an impedance closer to a short-circuited state in the second frequency band than in the first frequency band and closer to an open state in the first frequency band than in the second frequency band, and the first reactance element is provided at a position at which the first reactance element, the radiation element, and the ground conductor define the loop circuit when the first reactance element is closer to the short-circuited state.

3. The antenna device according to claim 1, wherein the first reactance element is an inductor that is capacitive in the first frequency band and is inductive in the second frequency band.

4. The antenna device according to claim 1, further comprising:

a second reactance element that is connected in series respectively with the first reactance element, the radiation element, and the ground conductor; wherein the second reactance element is an element with an impedance closer to an open state in the second frequency band than in the first frequency band and closer to a short-circuited state in the first frequency band than in the second frequency band.

5. The antenna device according to claim 4, wherein the second reactance element is a capacitor that is inductive in the first frequency band and is capacitive in the second frequency band.

6. The antenna device according to claim 4, wherein the first reactance element, the second reactance element, and a feeder circuit that feeds communication signals of the second frequency band to respective ends of the second reactance element define a single RF module.

7. The antenna device according to claim 1, further comprising:

a third reactance element that is connected to a feeding point of a communication signal of the first frequency band to the radiation element and that has a higher impedance in the second frequency band than in the first frequency band.

8. The antenna device according to claim 1, wherein the radiation element is an antenna configured for cellular communication, and the loop circuit is an antenna configured for an HF band RFID system.

9. The antenna device according to claim 1, wherein the first reactance element includes a plurality of reactance elements connected in series.

10. An electronic apparatus comprising:

an antenna device;

a first feeder circuit configured to feed a communication signal of a first frequency band to the antenna device; and a second feeder circuit configured to feed a communication signal of a second frequency band or electric power to the antenna device; wherein the antenna device includes:

a radiation element of an electric field type antenna;

a ground conductor opposing the radiation element;

a feeder coil to which a feeder circuit of a communication signal of the second frequency band is connected and that is configured to achieve magnetic field coupling with a loop circuit of a magnetic field type antenna; and at least one first reactance element; wherein the at least one first reactance element is connected between the radiation element and the ground conductor;

the radiation element, the at least one first reactance element, and the ground conductor define a loop circuit of a magnetic field type antenna; and the radiation element is an antenna element configured for the first frequency band, and the loop circuit is an antenna element configured for the second frequency band that is lower than the first frequency band.

11. The electronic apparatus according to claim 10, wherein the first reactance element is an element with an impedance closer to a short-circuited state in the second frequency band than in the first frequency band and closer to an open state in the first frequency band than in the second frequency band, and the first reactance element is provided at a position at which the first reactance element, the radiation element, and the ground conductor define the loop circuit when the first reactance element is closer to the short-circuited state.

12. The electronic apparatus according to claim 10, wherein the first reactance element is an inductor that is capacitive in the first frequency band and is inductive in the second frequency band.

13. The electronic apparatus according to claim 10, further comprising:

a second reactance element that is connected in series respectively with the first reactance element, the radiation element, and the ground conductor; wherein the second reactance element is an element with an impedance closer to an open state in the second frequency band than in the first frequency band and closer to a short-circuited state in the first frequency band than in the second frequency band.

14. The electronic apparatus according to claim 13, wherein the second reactance element is a capacitor that is inductive in the first frequency band and is capacitive in the second frequency band.

15. The electronic apparatus according to claim 13, wherein the first reactance element, the second reactance element, and a feeder circuit that feeds communication signals of the second frequency band to respective ends of the second reactance element define a single RF module.

16. The electronic apparatus according to claim 10, further comprising:

a third reactance element that is connected to a feeding point of a communication signal of the first frequency band to the radiation element and that has a higher impedance in the second frequency band than in the first frequency band.

17. The electronic apparatus according to claim 10, wherein the radiation element is an antenna configured for cellular communication, and the loop circuit is an antenna configured for an HF band RFID system.

18. The electronic apparatus according to claim 10, wherein the first reactance element includes a plurality of reactance elements connected in series.

* * * * *